US009488136B2

(12) United States Patent
Pearce et al.

(10) Patent No.: US 9,488,136 B2
(45) Date of Patent: Nov. 8, 2016

(54) FUEL OXIDATION REDUCTION FOR HYBRID VEHICLES

(71) Applicant: Ford Global Technologies, LLC, Dearborn, MI (US)

(72) Inventors: Russell Randall Pearce, Ann Arbor, MI (US); Kenneth J. Kuenzel, Saline, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 462 days.

(21) Appl. No.: 14/035,840

(22) Filed: Sep. 24, 2013

(65) Prior Publication Data

US 2015/0083089 A1 Mar. 26, 2015

(51) Int. Cl.
*F02M 25/08* (2006.01)

(52) U.S. Cl.
CPC ..... *F02M 25/0809* (2013.01)

(58) Field of Classification Search
CPC ..... F02M 25/08; F02M 25/0809; F02M 25/0818; F02M 25/0827; F02M 25/0836; F02M 2025/0845; F02M 25/089; F02M 2025/0881; F02M 37/00; F02M 37/0023; F02M 37/0052; F02M 37/0058; F02M 37/0082; F02M 37/0088; F02M 37/0094
USPC ..... 123/505, 510, 512, 513, 516, 518, 519, 123/520, 521, 461, 698, 704; 60/508, 512
See application file for complete search history.

(56) References Cited

U.S. PATENT DOCUMENTS 4,600,114 A 7/1986 Dabich
4,651,889 A * 3/1987 Uranishi ..... B60K 15/04 123/519
4,862,856 A * 9/1989 Yokoe ..... B60K 15/03504 123/519
4,944,779 A * 7/1990 Szlaga ..... B60K 15/03504 123/519
5,056,493 A * 10/1991 Holzer ..... B60K 15/00 123/516
5,242,750 A 9/1993 Wagner et al.
5,261,379 A * 11/1993 Lipinski ..... F02M 25/0809 123/198 D
5,425,344 A * 6/1995 Otsuka ..... F02M 25/0809 123/198 D
5,460,135 A * 10/1995 Ohashi ..... B60K 15/03 123/518
5,596,971 A * 1/1997 Kidokoro ..... B60K 15/03504 123/516
5,647,333 A * 7/1997 Mukai ..... F02D 41/004 123/519
5,722,374 A * 3/1998 Kidokoro ..... B60K 15/035 123/516
5,746,186 A * 5/1998 Kidokoro ..... B60K 15/03 123/516
5,868,120 A * 2/1999 Van Wetten ..... B60K 15/03504 123/518
5,967,124 A * 10/1999 Cook ..... F02M 25/0818 123/198 D (Continued)

OTHER PUBLICATIONS

Takashima, T., et al., "Manufactoring the Bladder Fuel Tank for Vapor Fuel Tank System." SAE Technical Paper Series 2001-01-0972, SAE World Congress, Detroit, MI., Mar. 5-8, 2001, 7 pages.

(Continued)

*Primary Examiner* — Hung Q Nguyen
*Assistant Examiner* — John Bailey
(74) *Attorney, Agent, or Firm* — James Dottavio; Alleman Hall McCoy Russell & Tuttle LLP

(57) ABSTRACT

Systems and methods to control fuel tank pressure to reduce fuel oxidation in plug-in hybrid electric vehicles are disclosed. A method comprises routing vapors from a fuel system canister to the fuel tank to maintain the fuel tank pressure at a desired pressure. In this way, the engine may be maintained off for greater durations while still retaining fuel quality of fuel stored on-board the vehicle.

11 Claims, 14 Drawing Sheets

(56) References Cited

U.S. PATENT DOCUMENTS 6,240,908 B1 * 6/2001 Hyodo ..... F02M 25/0809 123/198 D
6,301,955 B1 * 10/2001 Cook ..... F02M 25/0818 73/114.39
6,360,729 B1 3/2002 Ellsworth
6,371,089 B1 * 4/2002 Matsuoka ..... B60K 6/365 123/519
6,446,614 B1 * 9/2002 Matsuoka ..... F02D 29/06 123/516
6,575,146 B1 * 6/2003 Kanai ..... B60K 6/365 123/520
6,681,789 B1 1/2004 Moulis et al.
6,698,475 B2 * 3/2004 Schaefer ..... B60K 15/03504 123/519
6,874,484 B2 4/2005 Benjey
7,261,092 B1 * 8/2007 Oku ..... F02M 25/089 123/516
7,536,251 B2 * 5/2009 Saito ..... B60W 10/26 123/480
7,600,506 B2 10/2009 Kopinsky
7,665,447 B2 2/2010 Shinagawa et al.
7,980,228 B2 7/2011 Peters et al.
8,245,699 B2 8/2012 Peters et al.
8,375,701 B2 2/2013 Lupescu et al.
2001/0032624 A1 * 10/2001 Perry ..... B60K 15/035 123/510
2002/0056441 A1 * 5/2002 Holder ..... F02M 1/165 123/447
2002/0185115 A1 * 12/2002 Capshaw ..... F02M 37/20 123/518
2005/0044938 A1 * 3/2005 Tsuruta ..... F02M 25/0818 73/114.41
2006/0011173 A1 * 1/2006 Davis ..... B60K 15/03177 123/520
2007/0062495 A1 * 3/2007 Kano ..... F02D 41/0045 123/520
2007/0295313 A1 * 12/2007 Amano ..... F02D 41/0032 123/520
2009/0031996 A1 * 2/2009 Chung ..... F02M 31/20 123/518
2010/0223984 A1 * 9/2010 Pursifull ..... F02M 25/0836 73/114.39
2010/0294251 A1 * 11/2010 Makino ..... F02M 25/0836 123/519
2011/0139130 A1 * 6/2011 Siddiqui ..... F02M 25/0818 123/520
2011/0162625 A1 * 7/2011 Espinoza ..... F02M 25/08 123/521
2011/0166765 A1 * 7/2011 Debastos ..... B60K 15/03504 701/102
2011/0168140 A1 * 7/2011 Debastos ..... F02M 25/0818 123/521
2011/0295482 A1 * 12/2011 Pearce ..... B60K 15/03504 701/102
2012/0318793 A1 12/2012 Uchida
2013/0008911 A1 1/2013 Cragel et al.
2013/0037007 A1 2/2013 Reddy
2014/0026865 A1 * 1/2014 Dudar ..... F02M 25/0818 123/518
2014/0216420 A1 * 8/2014 Hagen ..... B60K 15/03177 123/518

OTHER PUBLICATIONS

Hayashi, K. et al., "Development of Multi-Layer Plastic Membrane (Bladder Membrane) for Vapor Reducing Fuel Tank," SAE Technical Paper Series 2001-01-1120, SAE World Congress, Detroit, MI., Mar. 5-8, 2001, 6 pages.

* cited by examiner

FUEL OXIDATION REDUCTION FOR HYBRID VEHICLES

TECHNICAL FIELD

The present disclosure relates to reduction of fuel oxidation in plug-in hybrid vehicles.

BACKGROUND AND SUMMARY

Hybrid vehicles, such as plug-in hybrid vehicles, may have two modes of operation: an engine-off mode and an engine-on mode. While in the engine-off mode, power to operate the vehicle may be supplied by stored electrical energy. While in the engine-on mode, the vehicle may operate using engine power. By switching between electrical and engine power sources, engine operation times may be reduced, thereby reducing overall carbon emissions from the vehicle. However, shorter engine operation times may lead to insufficient purging of fuel vapors from the vehicle's emission control system. Additionally, refueling and emission control system leak detection operations that are dependent on pressures and vacuums generated during engine operation may also be affected by the shorter engine operation times in hybrid vehicles.

In some conditions (e.g., city driving), an engine-off mode predominates and fuel may not be needed. Because fuel needs are reduced, fuel may remain in an onboard fuel tank for long time periods. As fuel remains in the fuel tank, it may be exposed to air within the tank and oxidize. Oxidation may occur when additional oxygen is ingested into the sealed environment of the fuel system. Oxidized fuel may be detrimental to plastics and metals found in a fuel system. In a closed system, such as a barrel of test fuel, the fuel does not age or deteriorate for a minimum of two years. Even after two years the fuel is still usable and combustion properties only begin to diminish.

For current plug-in hybrids or off-vehicle charge capable hybrid electric vehicle, attempts to protect against fuel oxidation and deterioration have involved burning fuel even when the vehicle is not demanding the gasoline powered internal combustion engine. A sealed or non-integrated refueling canister only system (NIRCOS) only allows air into the system typically in two methods, either mass may be removed from the fuel tank system, or a significant diurnal temperature or several thousand foot elevation change may occur. Removing mass may be accomplished by engine demand, such as in the example of utilizing an internal combustion engine even when power needs of the automobile are capable of being met by an engine-off mode.

Multiple embodiments of systems and methods for reducing fuel oxidation in a plug-in hybrid vehicle are provided. One method may include monitoring fuel tank pressure (FTP) and when below a threshold FTP, routing vapors to the fuel tank from a fuel system canister to maintain FTP at a desired pressure. Additionally, or alternatively, a portion or segment of a fuel tank may comprise a deformable material that may contract or expand with changes in FTP. Still further, a foam insert within the fuel tank may expand or contract to counteract changes in FTP. Also, vapor pressure within a fuel tank may be controlled by positive and negative pressure relief points that may employ expandable diaphragms. Still another approach may include a diaphragm chamber positioned between the tank and a fuel tank isolation valve (FTIV) pump to apply or remove pressure based on FTP. In yet another approach, a variable volume material may be used throughout a fuel tank that may expand or contract to counteract FTP, containing vapors at different barometric pressures, or temperatures.

In this way, it may be possible to mimic either an elevation change or significant temperature change to effectively remove vapor mass and reduce oxidation of onboard fuel. For example, such an approach may take advantage of NIRCOS or pressurized systems having pressure and vacuum relief for component protection. By expanding upon or subtly altering a pressure relief systems, it is possible to better manage fuel in the system, while reducing cost and packaging space.

Note that various systems and methods to control fuel tank pressure to reduce fuel oxidation in plug-in hybrid electric vehicles are disclosed. For example, in one example, a method comprises routing vapors from a fuel system canister to the fuel tank to maintain the fuel tank pressure at a desired pressure when fuel tank pressure is below a threshold. The routing of fuel vapors may be accomplished by a pump located between the fuel tank and the fuel system canister, or diverter valve from the canister allowing air into the canister to push vapor from the canister into the fuel tank. Again, such an approach enables fuel vapors to be managed in a way that reduces a need to run the engine only due to a need for fuel vapor purging, while also extending life of the fuel stored onboard by reducing the degree of pressure and temperature swings to which it is subjected.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure. Further, the inventors herein have recognized the disadvantages noted herein, and do not admit them as known.

DETAILED DESCRIPTION

The present disclosure describes systems and methods for controlling pressure within a fuel tank onboard a plug-in hybrid vehicle. Control of FTP pressure may minimize air vapor entering the tank and reduce fuel oxidation reducing chemical degradation of fuel system components. The system, in its various embodiments is described in greater detail below with reference to the FIGS.

Figure 1:
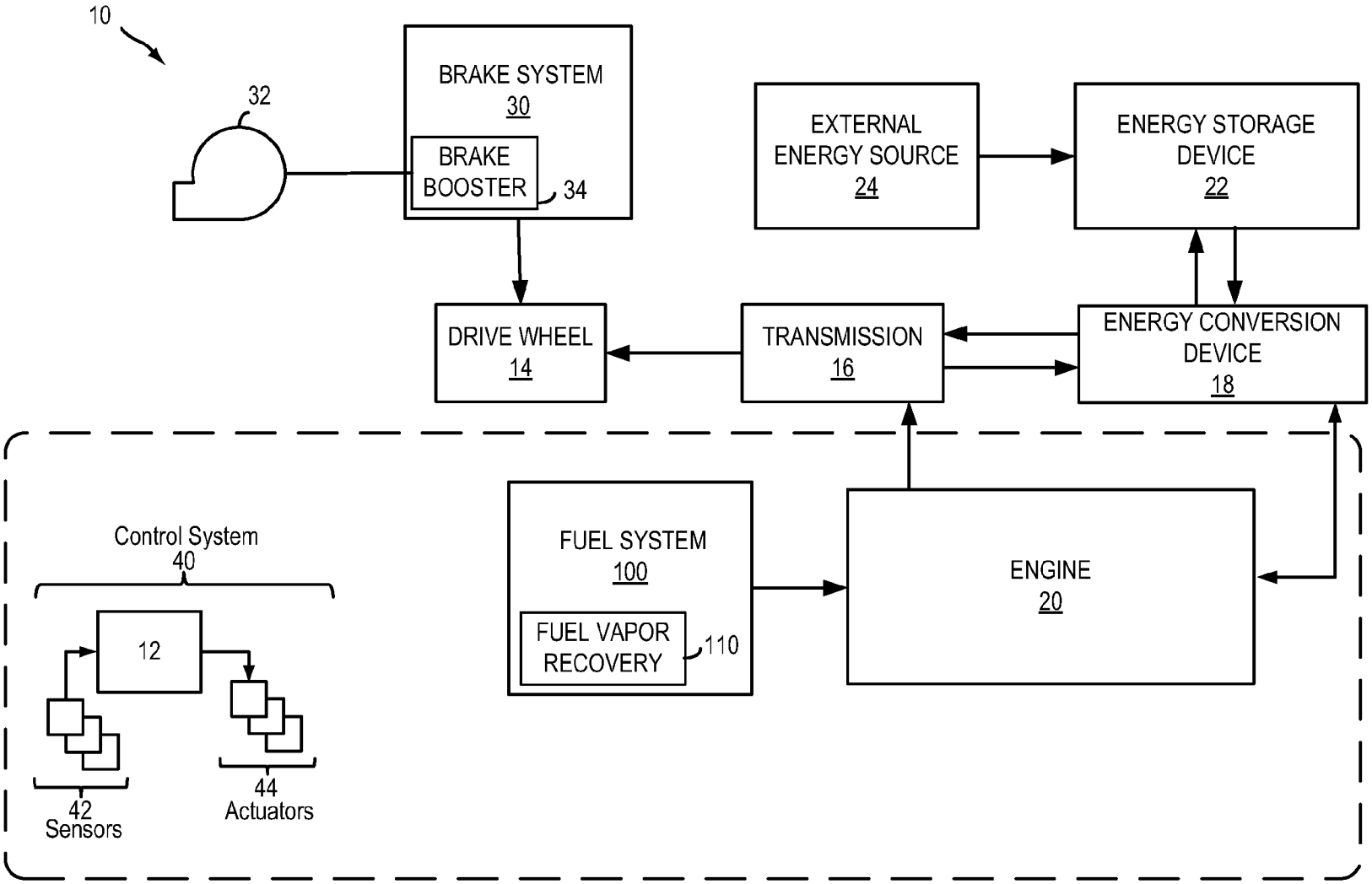
FIG. 1 shows a schematic depiction of a hybrid vehicle.
Figure 2:
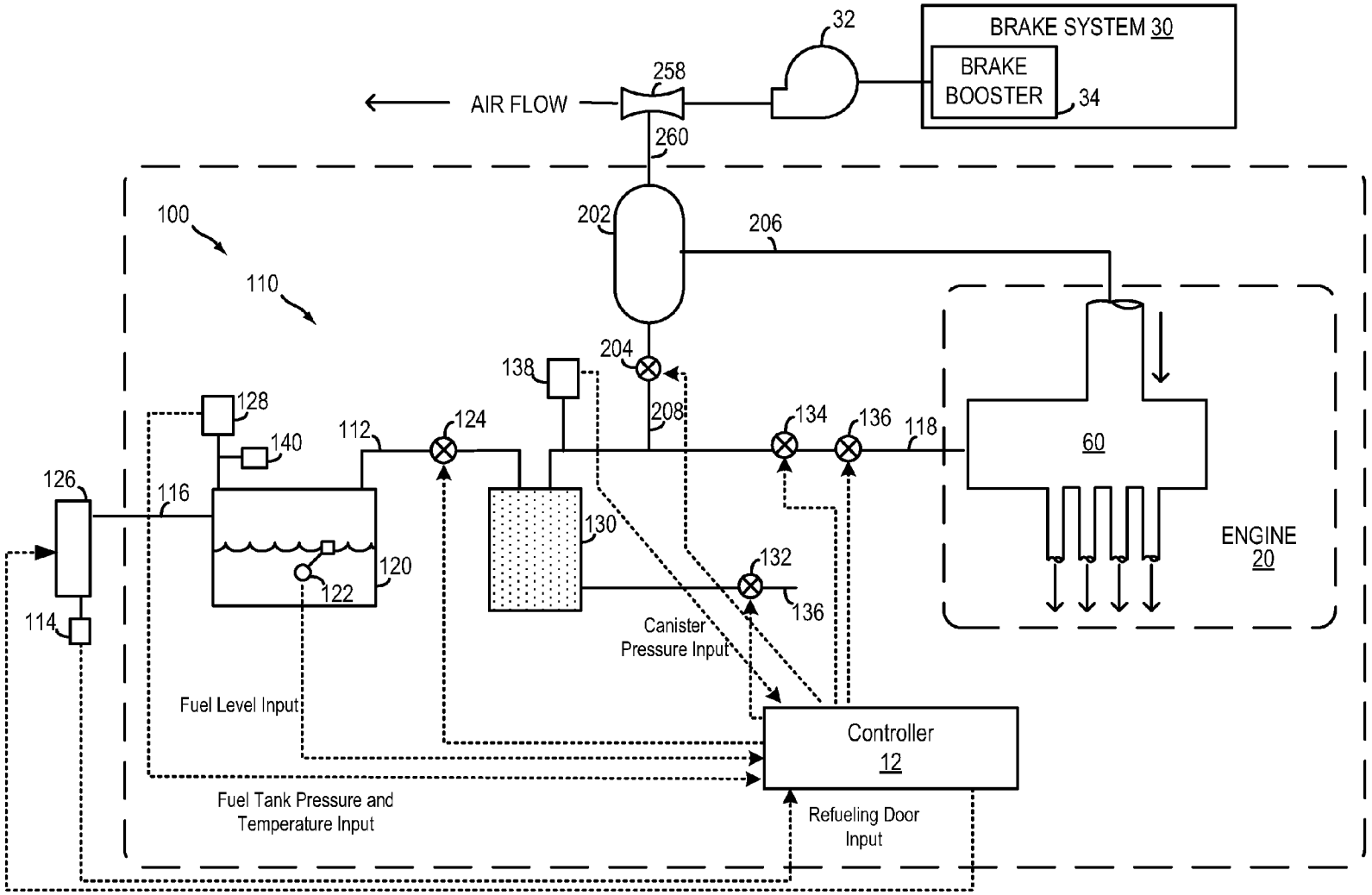
FIG. 2 shows an example fuel system and fuel vapor recovery system of FIG. 1.
Figure 3:
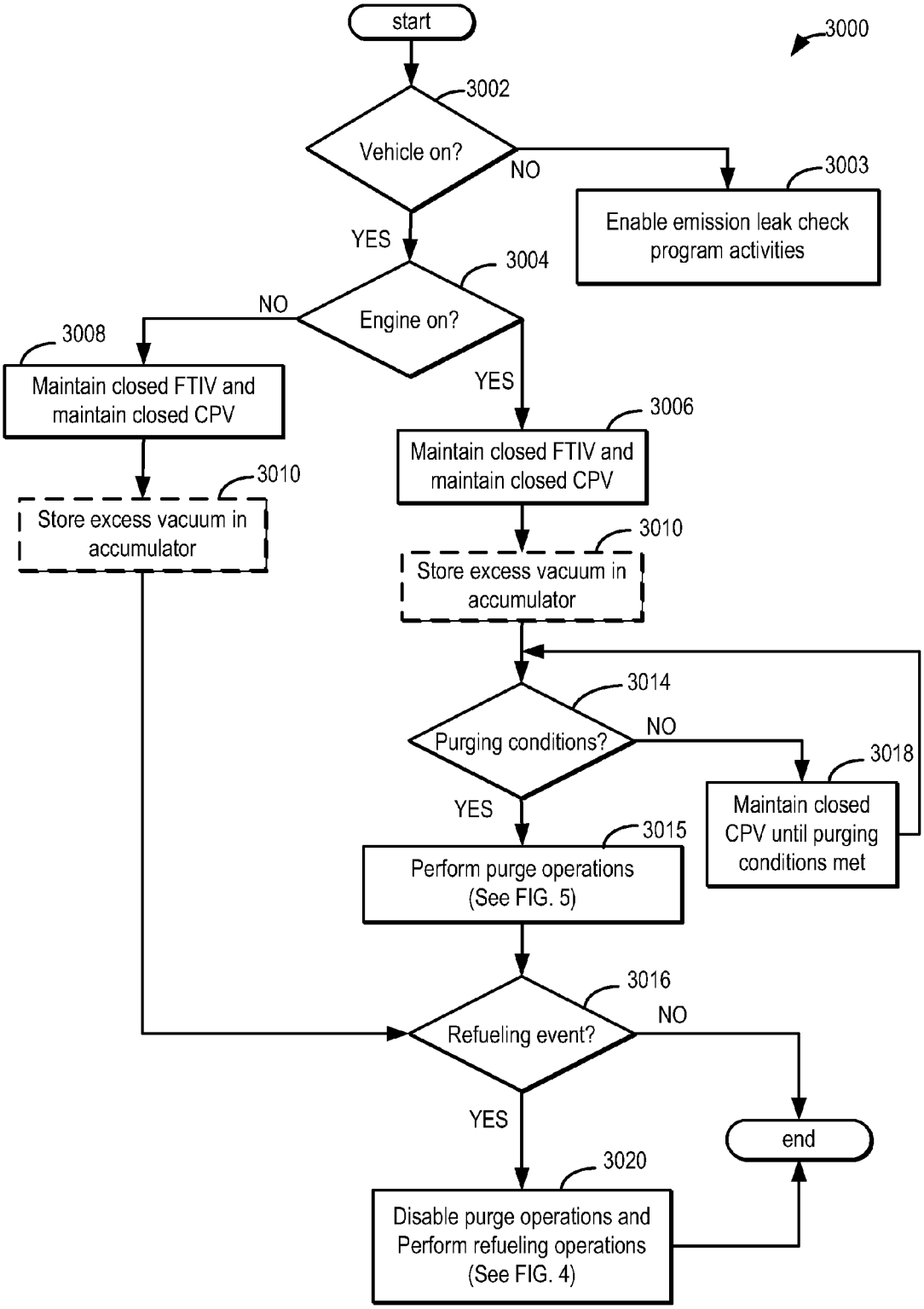
FIG. 3 shows a high level flow chart for operating the fuel vapor recovery system of FIG. 2.
Figure 4:
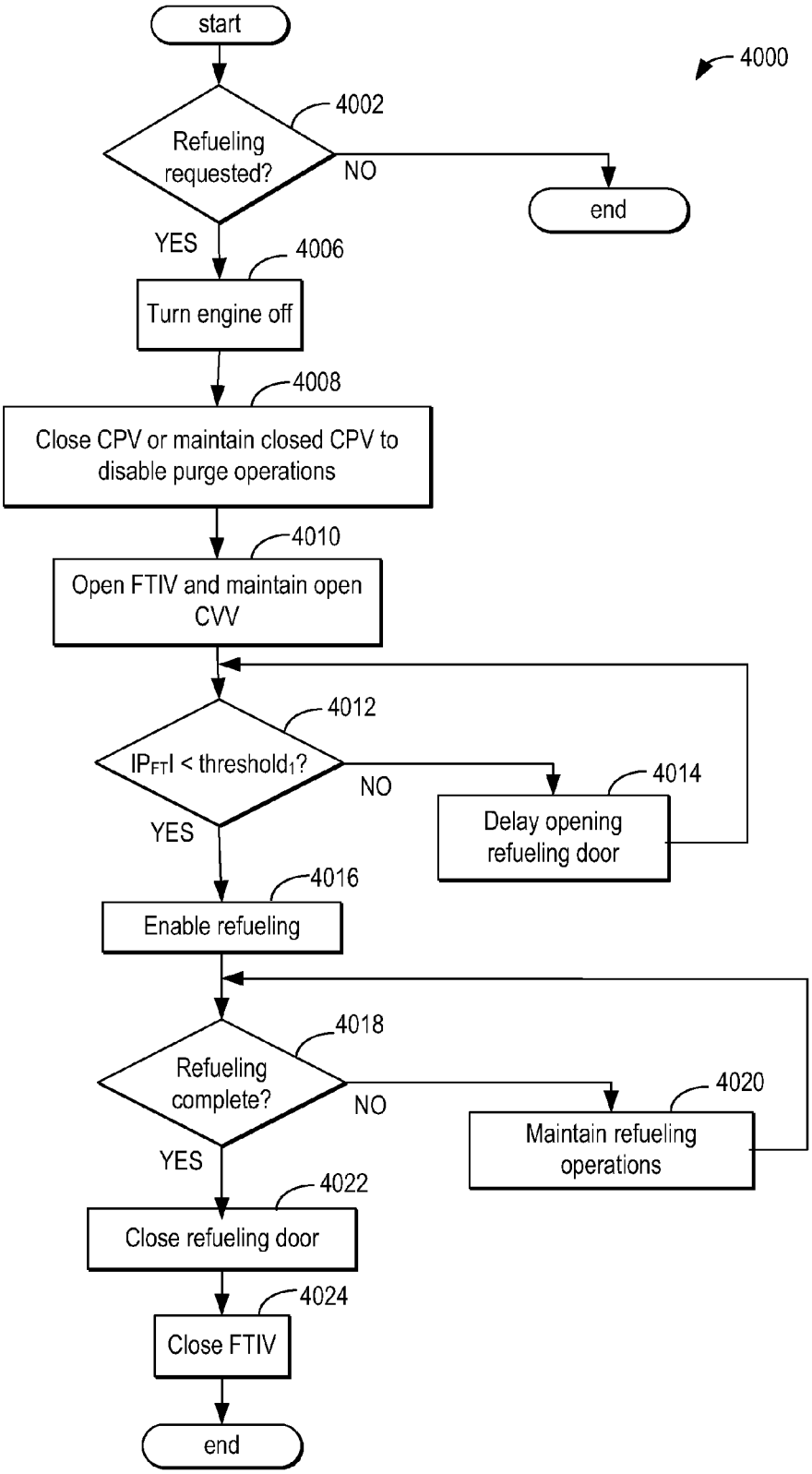
FIG. 4 shows a high level flow chart for operating the fuel vapor recovery system during a refueling event.
Figure 5:
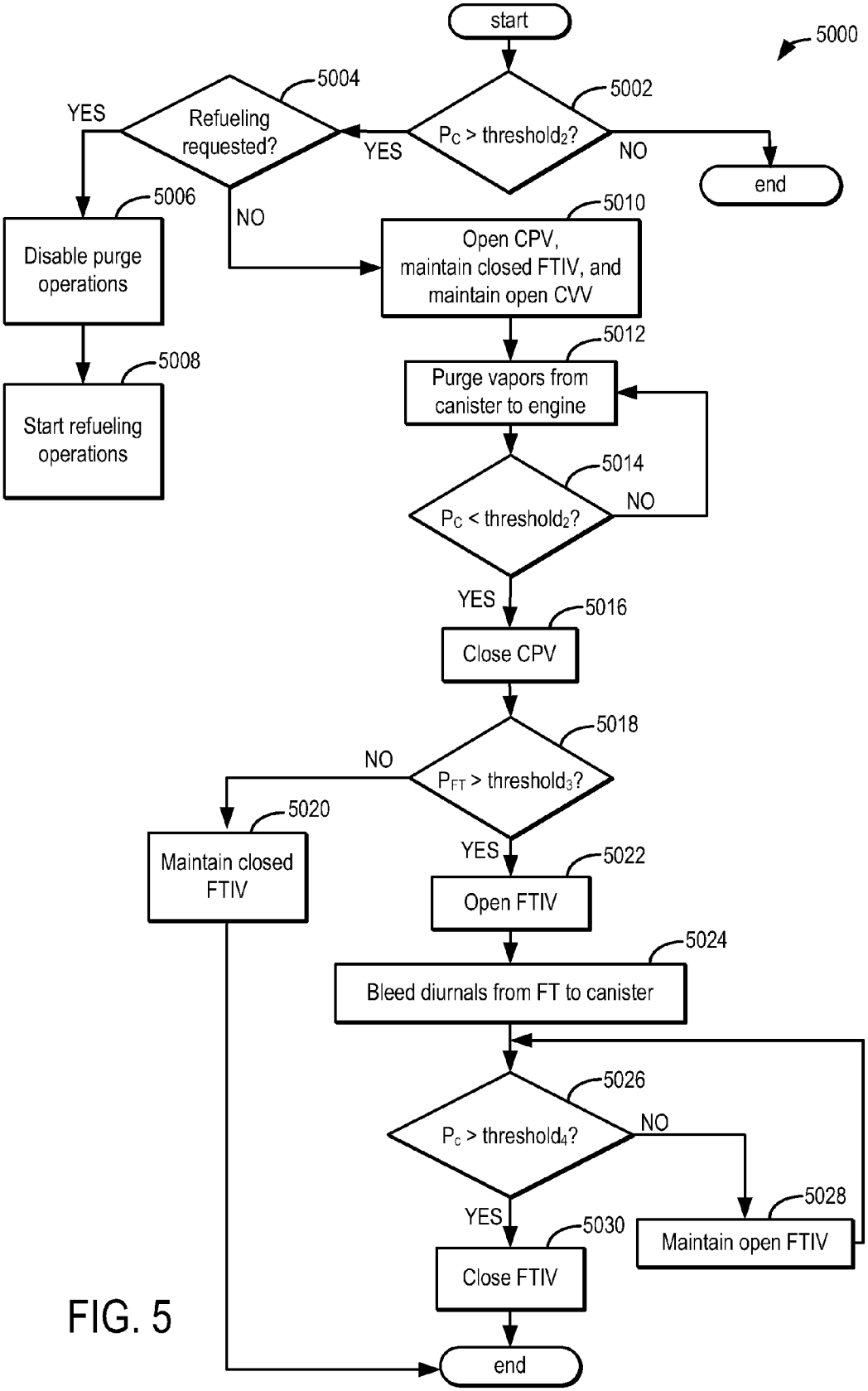
FIG. 5 shows a high level flow chart for operating the fuel vapor recovery system during a purging event.
Figure 6:
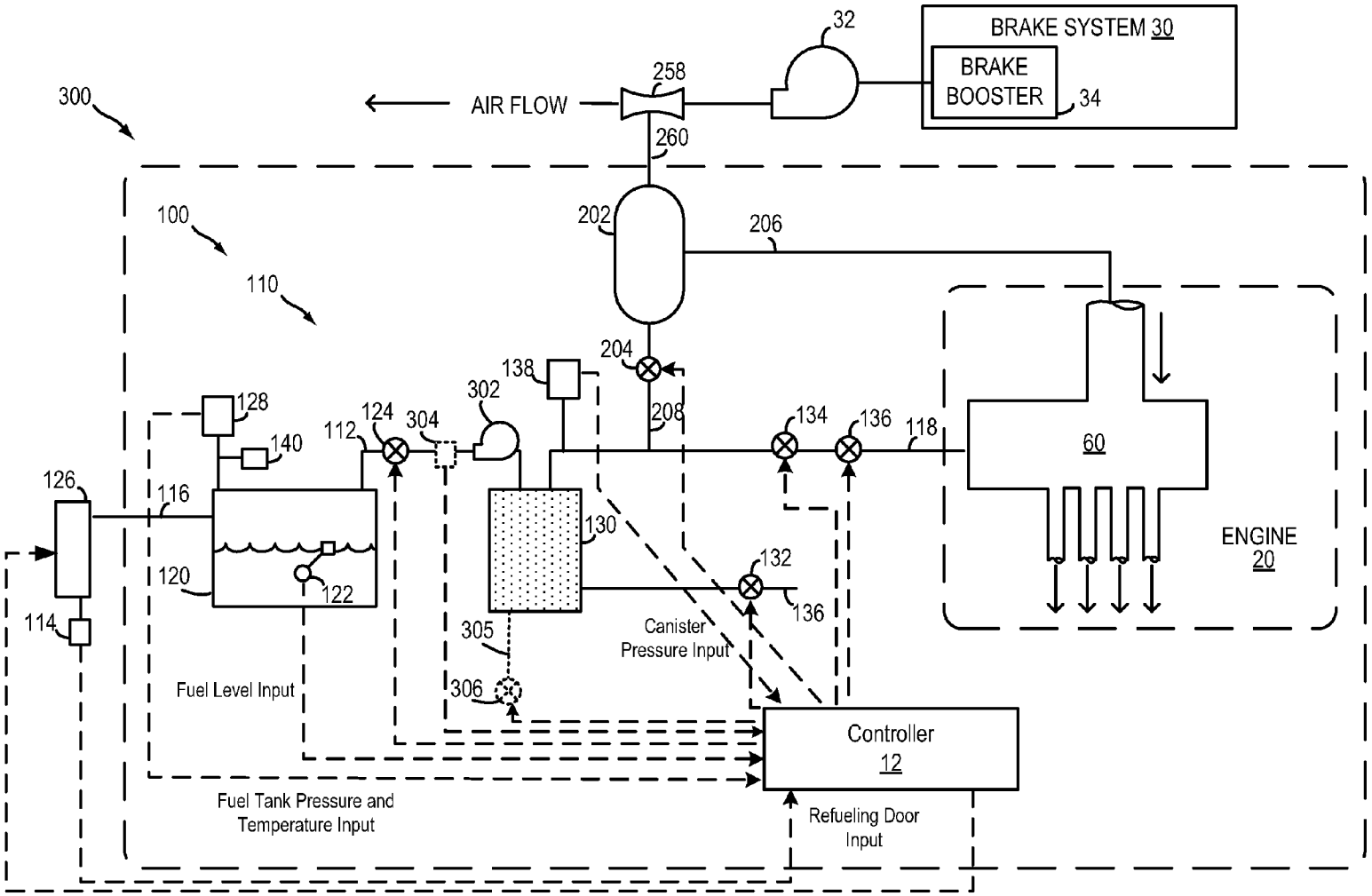
FIG. 6 shows a first embodiment of a fuel tank pressure system.
Figure 8A:
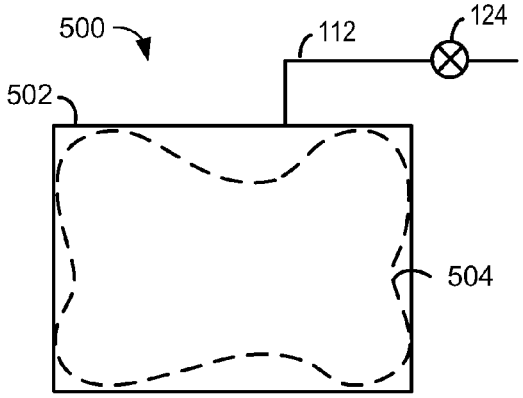
FIG. 8A shows a second embodiment of a fuel tank pressure system.
Figure 8B:
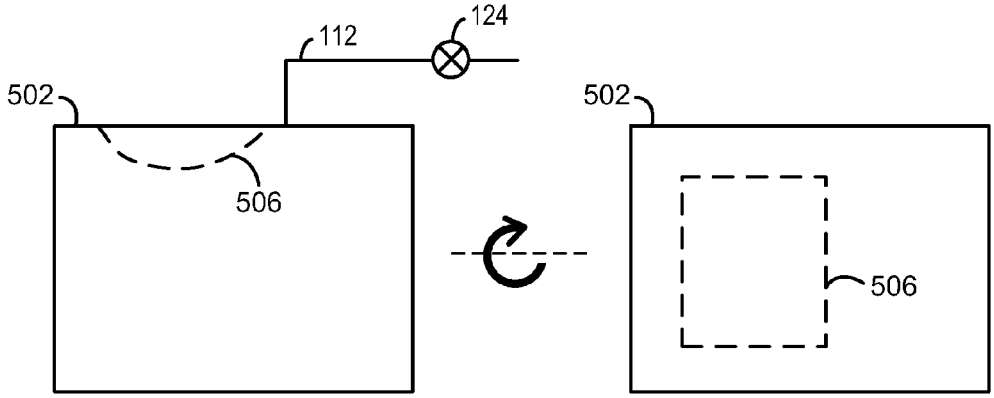
FIG. 8B shows a variation of the second embodiment of a fuel tank pressure system.
Figure 8C:
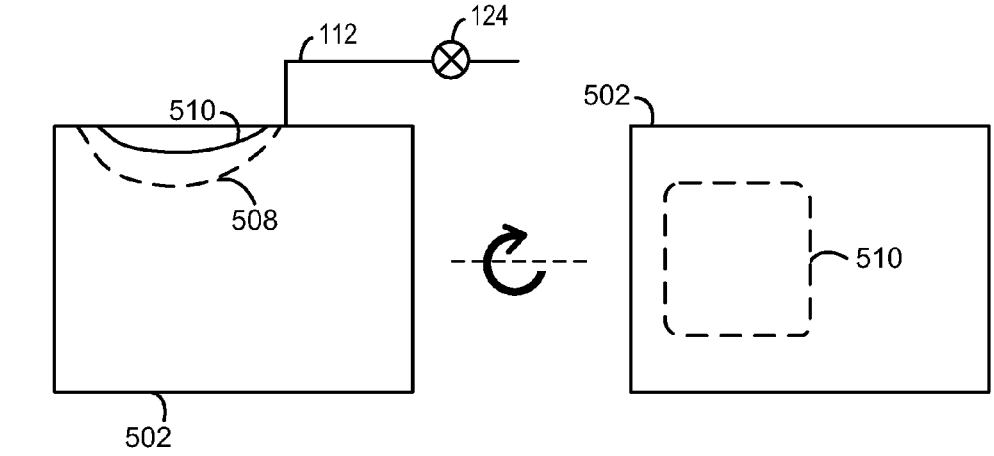
FIG. 8C shows a variation of the second embodiment of a fuel tank pressure system.
Figure 9A:
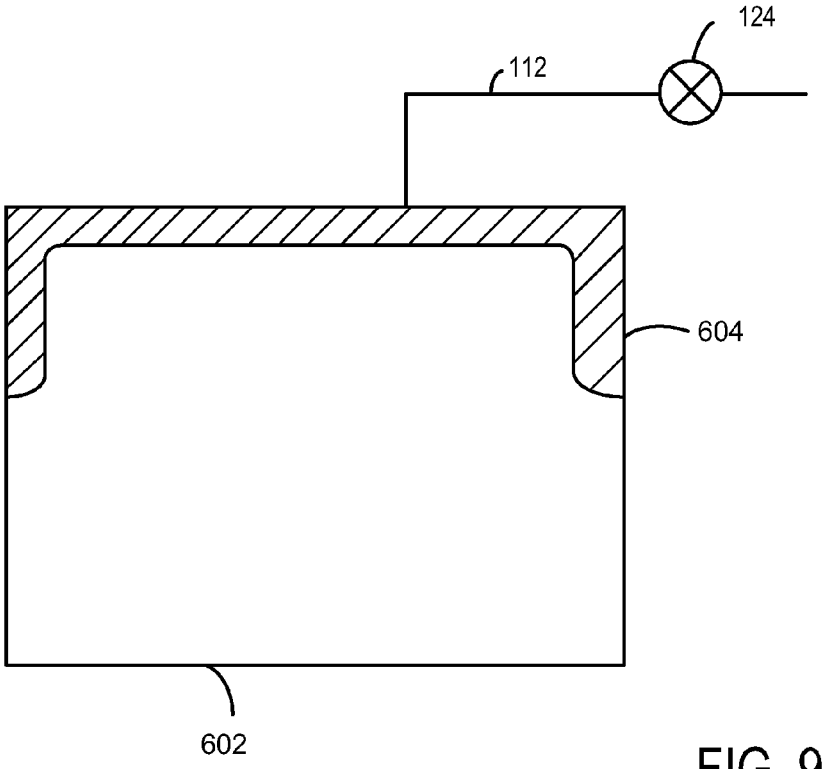
FIG. 9A shows a third embodiment of a fuel tank pressure system.
Figure 9B:
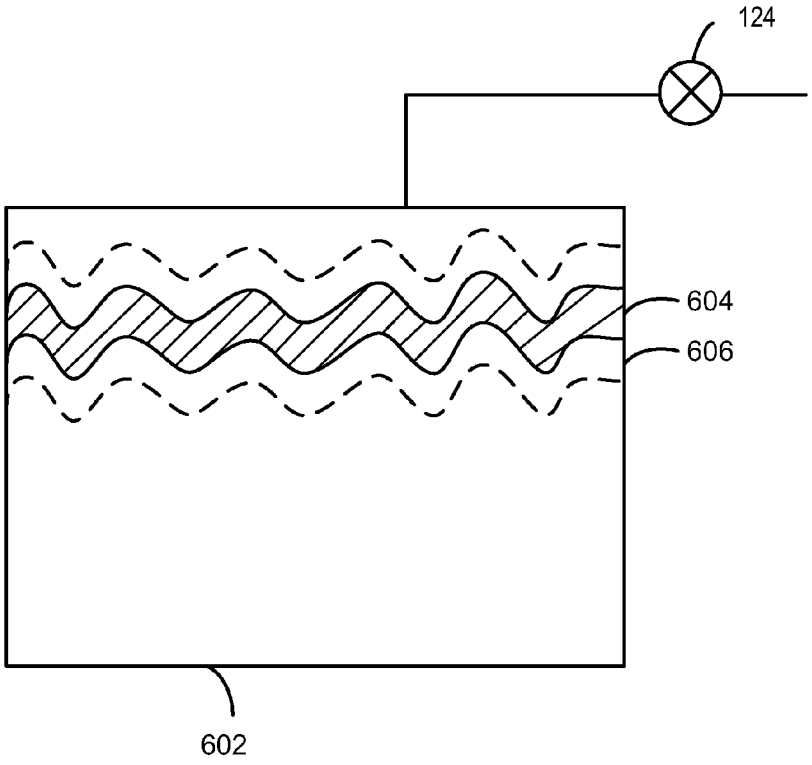
FIG. 9B shows a variation of the third embodiment of a fuel tank pressure system.
Figure 10:
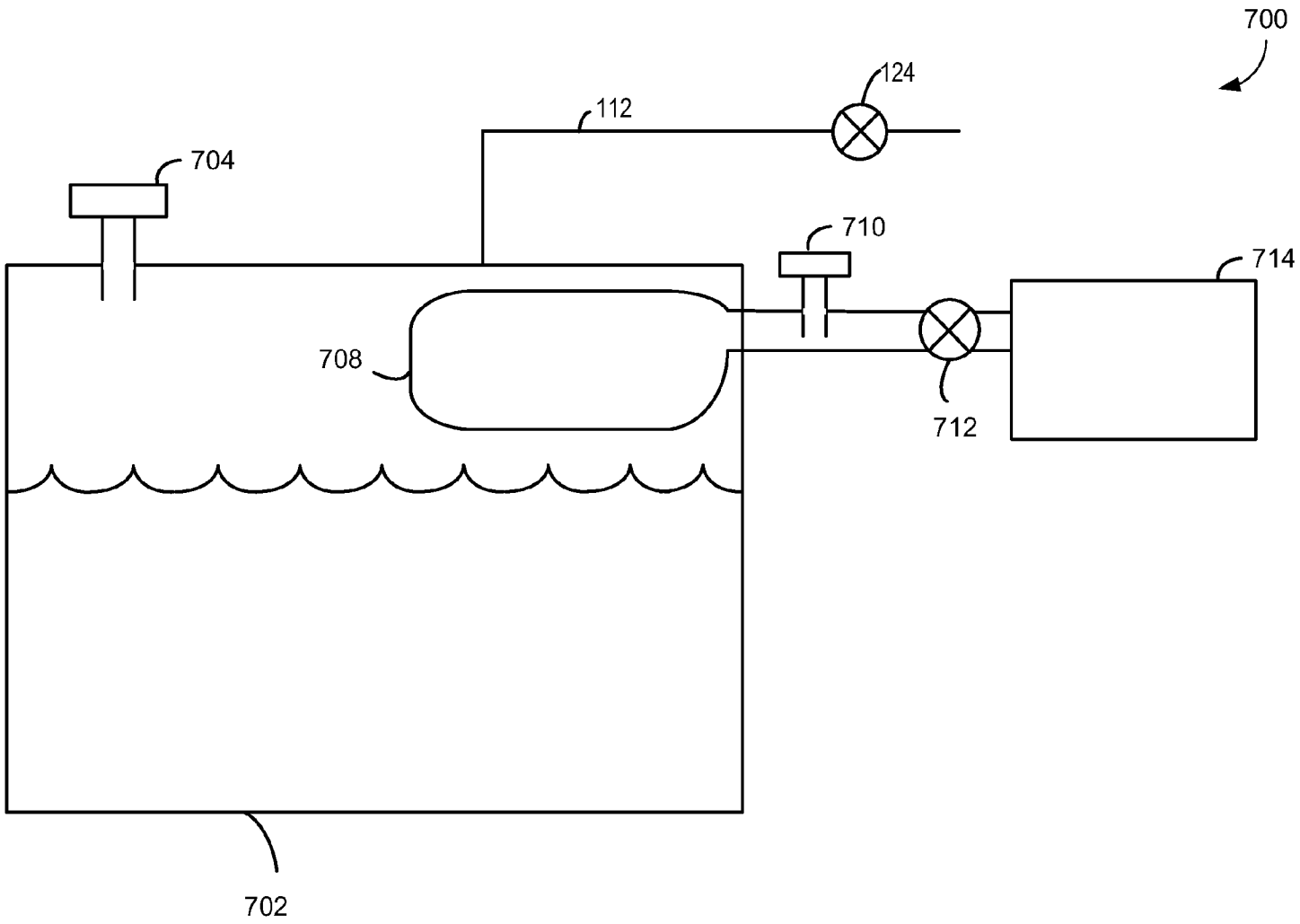
FIG. 10 shows a fourth embodiment of a fuel tank pressure system.
Figure 11:
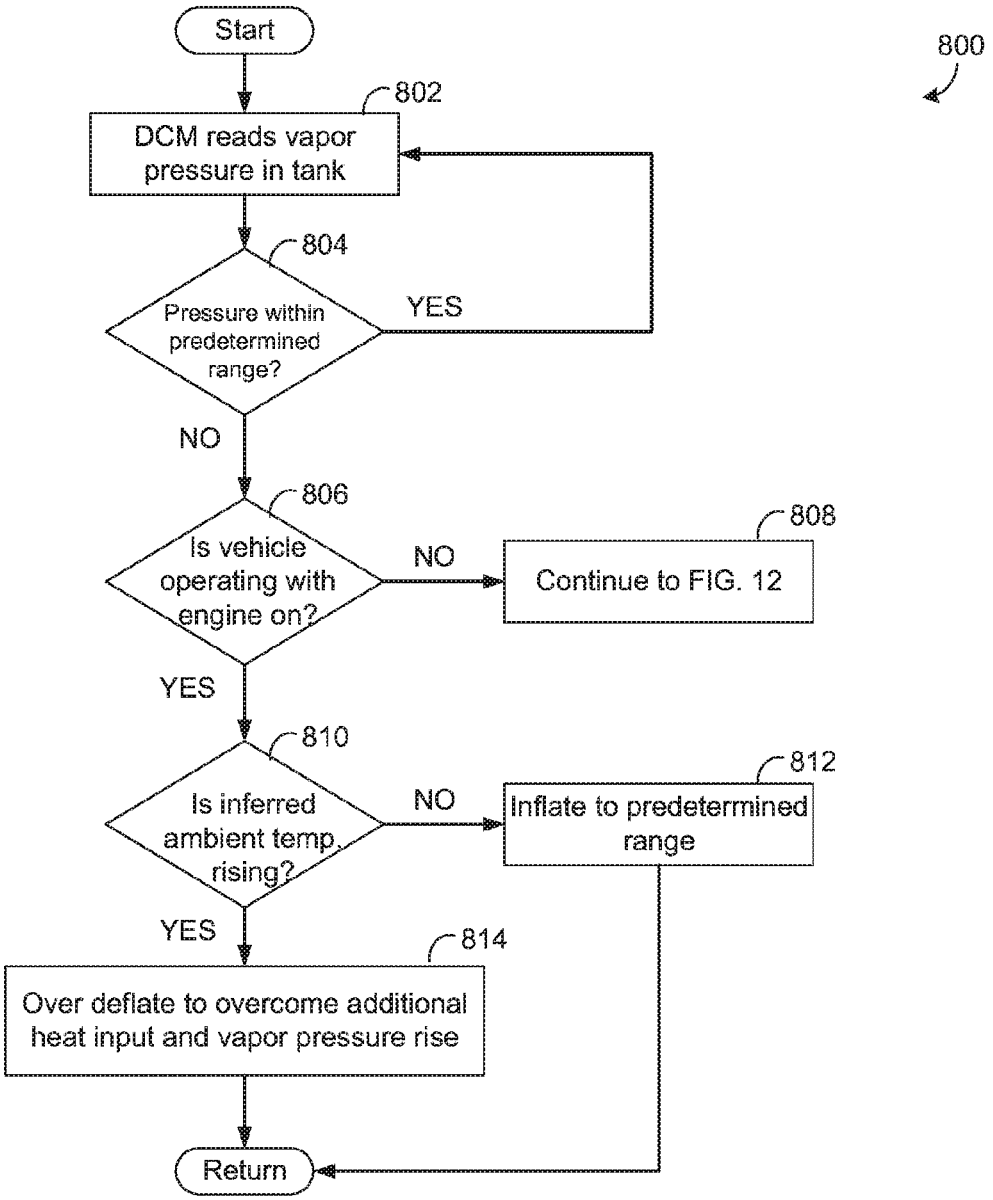
FIG. 11 shows a flowchart of a method of the fourth embodiment of the fuel tank pressure system.
Figure 12:
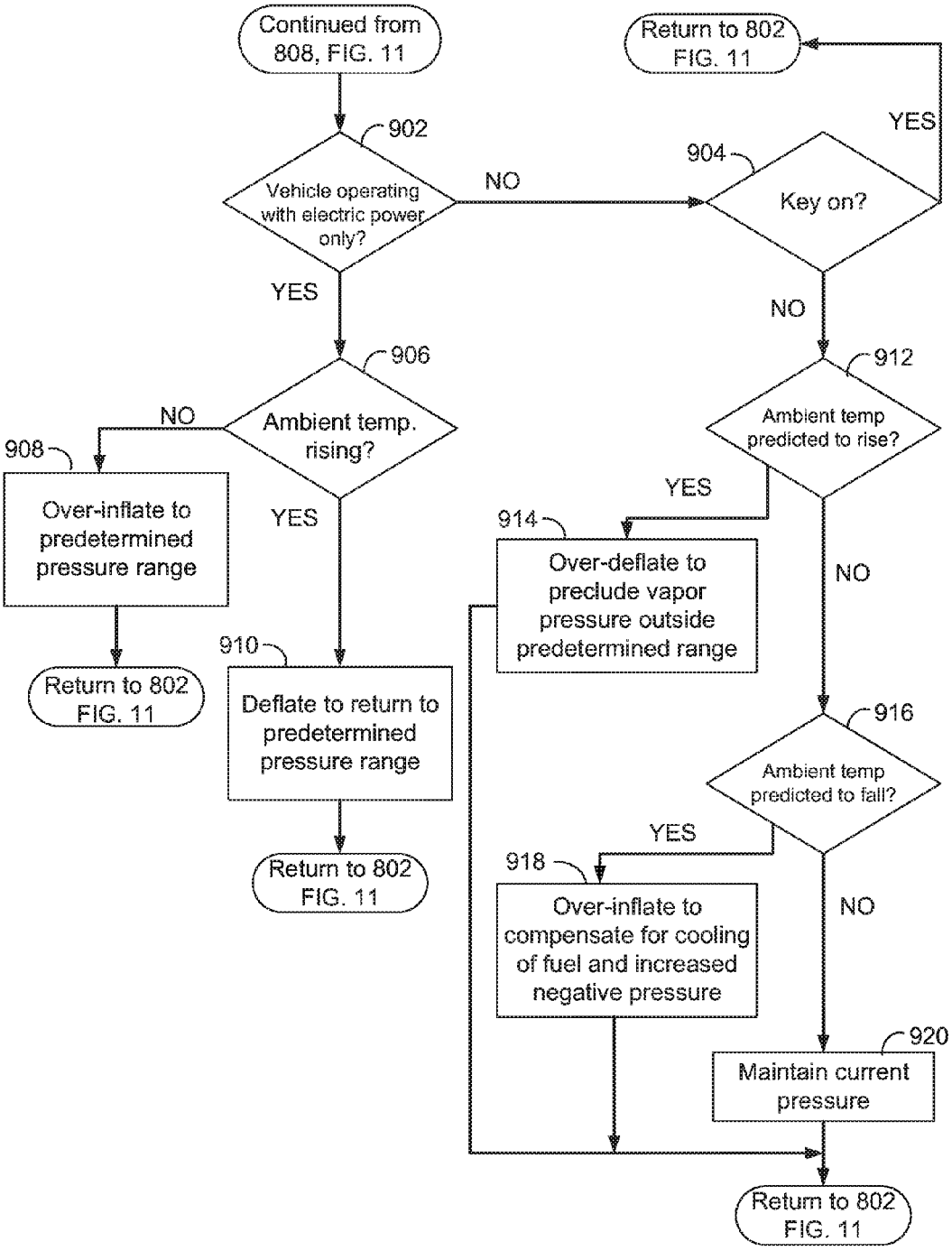
FIG. 12 shows a continued flow charter of the fourth embodiment of the fuel tank pressure system.
Figure 13:
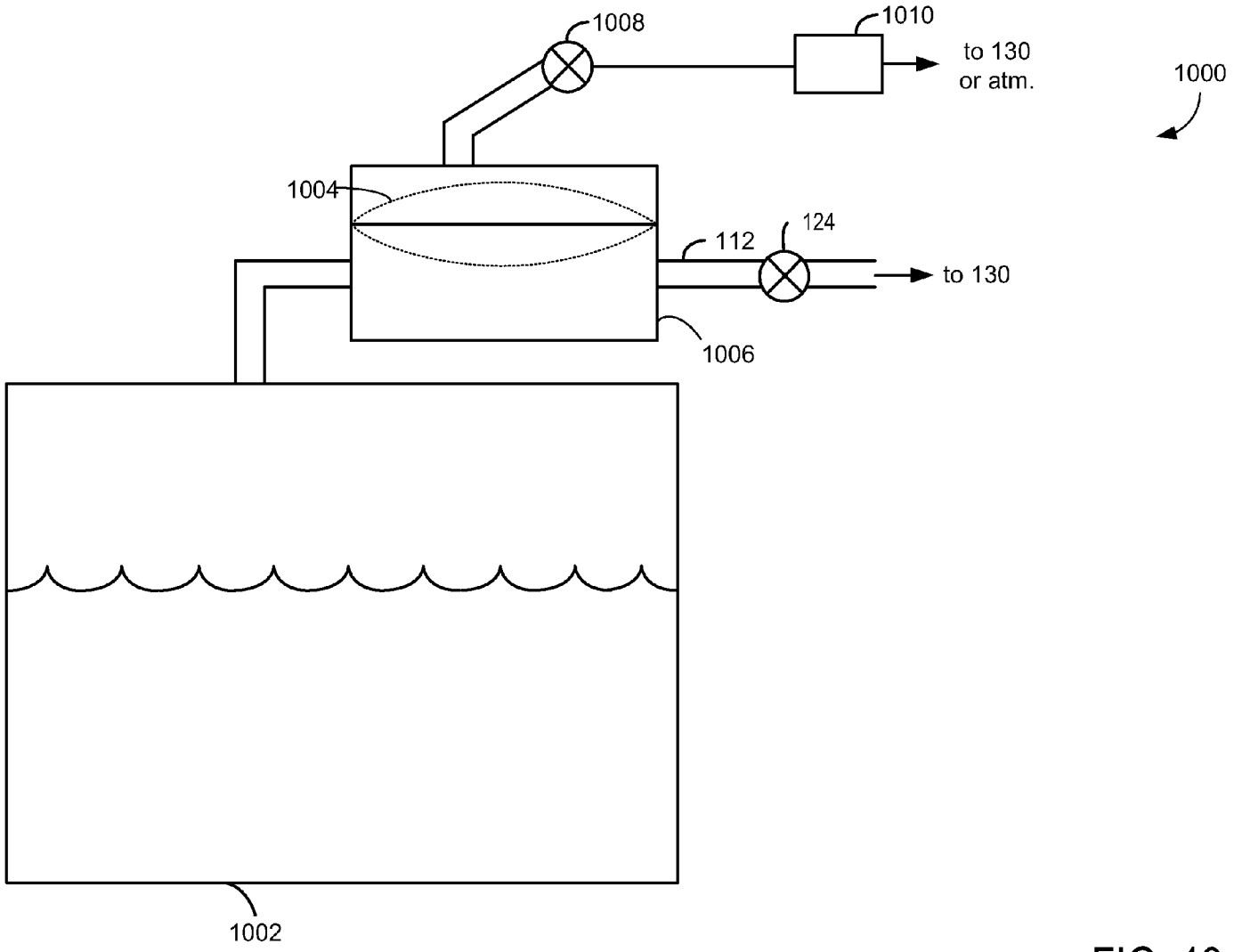
FIG. 13 shows a fifth embodiment of a fuel tank pressure system.
Figure 14:
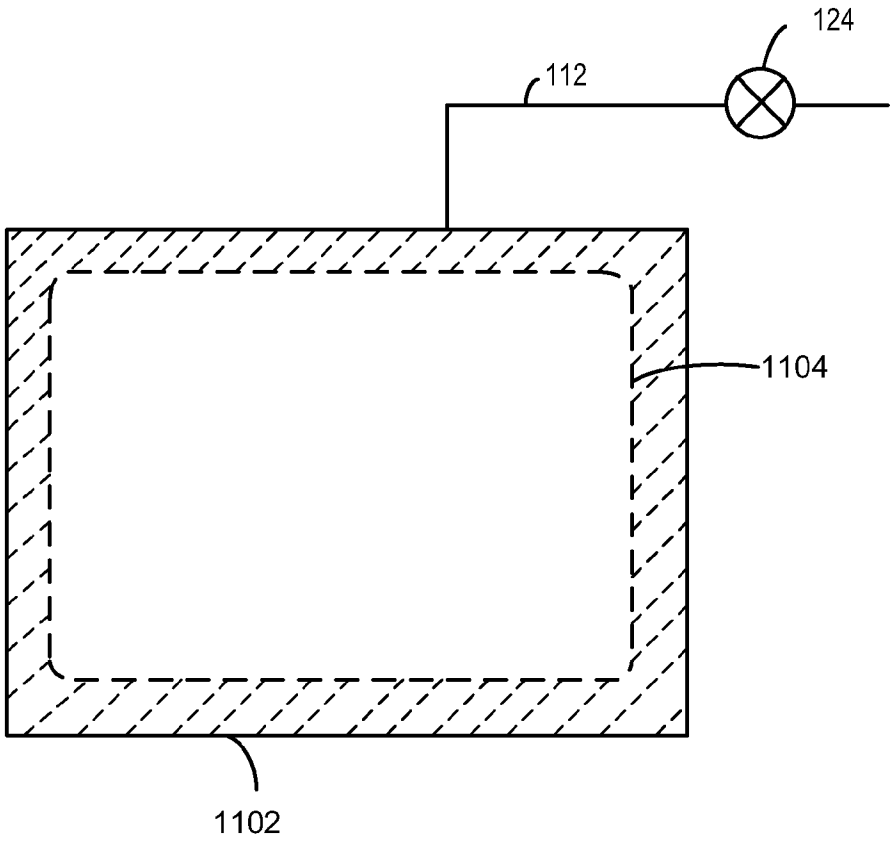
FIG. 14 shows a sixth embodiment of a fuel tank pressure system.

FIGS. 1 and 2 show general schematic drawings of a plug-in hybrid vehicle and an associate fuel system respectively and FIGS. 3-5 show methods of operating the fuel system. FIGS. 6 and 7 show a system and method of a first embodiment of a FTP system. FIGS. 8A-C show variations of a second embodiment of a fuel tank pressure system. FIGS. 9A and 9B show variations of a third embodiment of the fuel tank pressure system. FIGS. 10 through 12 show a system and method of a fourth embodiment of a fuel tank pressure system. FIG. 13 shows a fifth embodiment of a fuel tank pressure system and FIG. 14 shows a sixth embodiment of a fuel tank pressure system.

Referring to FIG. 1, the figure schematically depicts a vehicle with a hybrid propulsion system 10. Hybrid propulsion system 10 includes an internal combustion engine 20 coupled to transmission 16. Transmission 16 may be a manual transmission, automatic transmission, or combinations thereof. Further, various additional components may be included, such as a torque converter, and/or other gears such as a final drive unit, etc. Transmission 16 is shown coupled to drive wheel 14, which may contact a road surface.

In this example embodiment, the hybrid propulsion system also includes an energy conversion device 18, which may include a motor, a generator, among others and combinations thereof. The energy conversion device 18 is further shown coupled to an energy storage device 22, which may include a battery, a capacitor, a flywheel, a pressure vessel, etc. The energy conversion device may be operated to absorb energy from vehicle motion and/or the engine and convert the absorbed energy to an energy form suitable for storage by the energy storage device (in other words, provide a generator operation). The energy conversion device may also be operated to supply an output (power, work, torque, speed, etc.) to the drive wheel 14 and/or engine 20 (in other words, provide a motor operation). It should be appreciated that the energy conversion device may, in some embodiments, include a motor, a generator, or both a motor and generator, among various other components used for providing the appropriate conversion of energy between the energy storage device and the vehicle drive wheels and/or engine.

The depicted connections between engine 20, energy conversion device 18, transmission 16, and drive wheel 14 may indicate transmission of mechanical energy from one component to another, whereas the connections between the energy conversion device 18 and the energy storage device 22 may indicate transmission of a variety of energy forms such as electrical, mechanical, etc. For example, torque may be transmitted from engine 20 to drive the vehicle drive wheel 14 via transmission 16. As described above energy storage device 22 may be configured to operate in a generator mode and/or a motor mode. In a generator mode, system 10 may absorb some or all of the output from engine 20 and/or transmission 16, which may reduce the amount of drive output delivered to the drive wheel 14, or the amount of braking torque from brake system 30, which includes brake booster 34 and brake booster pump 32, to the drive wheel 14. Such operations may be employed, for example, to achieve efficiency gains through regenerative braking, increased engine efficiency, etc. Further, the output received by the energy conversion device may be used to charge energy storage device 22. Alternatively, energy storage device 22 may receive electrical charge from an external energy source 24, such as a plug-in to a main electrical supply. In motor mode, the energy conversion device may supply mechanical output to engine 20 and/or transmission 16, for example by using electrical energy stored in an electric battery.

Hybrid propulsion embodiments may include full hybrid systems, in which the vehicle can run on just the engine, just the energy conversion device (e.g. motor), or a combination of both. Assist or mild hybrid configurations may also be employed, in which the engine is the primary torque source, with the hybrid propulsion system acting to selectively deliver added torque, for example during tip-in or other conditions. Further still, starter/generator and/or smart alternator systems may also be used.

From the above, it should be understood that the exemplary hybrid propulsion system is capable of various modes of operation. For example, in a first mode, engine 20 is turned on and acts as the torque source powering drive wheel 14. In this case, the vehicle is operated in an "engine-on" mode and fuel is supplied to engine 20 from fuel system 100 (depicted in further detail in FIG. 2). Fuel system 100 includes a fuel vapor recovery system 110 to store fuel vapors and reduce emissions from the hybrid vehicle propulsion system 10.

In another mode, the propulsion system may operate using energy conversion device 18 (e.g., an electric motor) as the torque source propelling the vehicle. This "engine-off" mode of operation may be employed during braking, low speeds, while stopped at traffic lights, etc. In still another mode, which may be referred to as an "assist" mode, an alternate torque source may supplement and act in cooperation with the torque provided by engine 20. As indicated above, energy conversion device 18 may also operate in a generator mode, in which torque is absorbed from engine 20 and/or transmission 16. Furthermore, energy conversion device 18 may act to augment or absorb torque during transitions of engine 20 between different combustion modes (e.g., during transitions between a spark ignition mode and a compression ignition mode).

The various components described above with reference to FIG. 1 may be controlled by a vehicle control system 40, which includes a controller 12 with computer readable instructions for carrying out routines and subroutines for regulating vehicle systems, a plurality of sensors 42, and a plurality of actuators 44. Select examples of the plurality of sensors 42 and the plurality of actuators 44 are described in further detail below, in the description of fuel system 100.

FIG. 2 shows the fuel system 100 and fuel vapor recovery system 110 of FIG. 1. Engine 20, coupled to a fuel system 100, may include a plurality of cylinders (not shown). Engine 20 may receive intake air through intake manifold 60 which may lead to an exhaust passage (not shown) that routes exhaust gas to the atmosphere (as indicated by arrows). It will be appreciated that the engine intake and exhaust manifolds may be additionally coupled to an emission control device and/or a boosting device.

Fuel system 100 may include a fuel tank 120 coupled to a fuel pump system for pressurizing fuel delivered to the injectors of engine 20 (not shown). It will be appreciated that fuel system 100 may be a return-less fuel system, a return fuel system, or various other types of fuel system. Vapors generated in fuel system 100 may be routed to a fuel vapor recovery system 110 via a first conduit, vapor line 112, before being purged to intake manifold 60 via a second conduit, purge line 118.

The fuel tank 120 may hold a plurality of fuel blends, including fuel with a range of alcohol concentrations, such as various gasoline-ethanol blends, including E10, E85, gasoline, etc., and combinations thereof. As depicted in FIG. 2, fuel tank 120 includes a fuel level sensor 122 which may comprise a float connected to a variable resistor. Alternatively, other types of fuel level sensors may be used. Fuel level sensor 122 sends fuel level input signals to controller 12.

Fuel tank 120 also includes a refueling line 116, which is a passageway between the refueling door 126, which includes a refueling valve (not shown) on the outer body of the vehicle and the fuel tank, wherein fuel may be pumped into the vehicle from an external source during a refueling event. Refueling door sensor 114 coupled to refueling door 126 may be a position sensor and send input signals of a refueling door open or closed state to controller 12. Refueling line 116 and vapor line 112 may each be coupled to an opening in fuel tank 120; therein fuel tank 120 has at least two openings.

As noted above, vapor line 112 is coupled to the fuel tank for routing of fuel vapors to a fuel vapor canister 130 of the fuel vapor recovery system 110. It will be appreciated that fuel vapor recovery system 110 may include one or more fuel vapor retaining devices, such as one or more of a fuel vapor canister 130. Canister 130 may be filled with an adsorbent capable of binding large quantities of vaporized hydrocarbons (HCs). In one example, the adsorbent used is activated charcoal.

Canister 130 may receive fuel vapors from fuel tank 120 through vapor line 112, as vapor line 112 is connected at an opposing end to an opening in canister 130. Canister 130 includes two additional openings, wherein a vent 136 and a purge line 118 are coupled, such that canister 130 has three openings. While the depicted example shows a single canister, it will be appreciated that in alternate embodiments, a plurality of such canisters may be connected together.

Opening of vapor line 112 is regulated by a fuel tank isolation valve (FTIV) 124. In an alternate embodiment FTIV 124 may be mounted directly to fuel tank 120 at the attachment point of vapor line 112. As such, during vehicle operation, FTIV 124 may be maintained in a closed state, such that refueling vapors may be stored in the canister on the canister side of the fuel vapor circuit and diurnal vapors may be retained in the fuel tank on the fuel tank side of the fuel vapor circuit. FTIV 124 may be operated on by controller 12 in response to a refueling request or an indication of purging conditions. In these instances, FTIV 124 may be opened to allow diurnal vapors to enter the canister and relieve pressure in the fuel tank. Additionally, FTIV 124 may be operated on controller 12 to perform specific steps of leak detection, such as applying a pressure (positive pressure or vacuum) from fuel tank 120 to canister 130. In one example, FTIV 124 may be a solenoid valve and operation of FTIV 124 may be regulated by the controller by adjusting a duty cycle of the dedicated solenoid (not shown).

A first fuel tank pressure sensor, such as a fuel tank pressure transducer (FTPT) 128, may be coupled to fuel tank 120 to provide an estimate of a fuel tank pressure. For example, FTPT 128 may be included in the top portion of fuel tank 120. In an alternate embodiment, FTPT 128 may be coupled to vapor line 112 on the fuel tank side of the fuel vapor circuit. Additionally, fuel tank 120 may include a temperature sensor 140 to provide an estimate of a fuel tank temperature. Temperature sensor 140 may be coupled to FTPT 128, as depicted in FIG. 2. In an alternate embodiment, temperature sensor 140 may be coupled to the fuel tank in a distinct location from FTPT 128. Each of pressure ($P_{FT}$) and temperature ($T_{FT}$) signals from FTPT 128 and temperature sensor 140, respectively, are received by controller 12.

Fuel vapor recovery system 110 may communicate with the atmosphere through vent 136, extending from canister 130. Canister vent valve (CVV) 132 may be located along vent 136, coupled between canister 130 and the atmosphere, and may adjust flow of air and vapors between fuel vapor recovery system 110 and the atmosphere. Operation of the CVV 132 may be regulated by a canister vent solenoid (not shown). Based on whether the fuel vapor recovery system is to be sealed or not sealed from the atmosphere, the CVV may be closed or opened. Specifically, controller 12 may energize the canister vent solenoid to close CVV 132 and seal the system from the atmosphere, such as during leak detection conditions.

In contrast, when the canister vent solenoid is at rest, the CVV 132 may be opened and the system may be open to the atmosphere, such as during purging conditions. Further still, controller 12 may be configured to adjust the duty cycle of the canister vent solenoid to thereby adjust the pressure at which CVV 132 is relieved. In one example, during a refueling vapor storing operation (for example, during a fuel tank refilling and/or while the engine is not running), the canister vent solenoid may be de-energized and the CVV may be opened so that air, stripped of fuel vapor after having passed through the canister, can be pushed out to the atmosphere. In another example, during a purging operation (for example, during a canister regeneration and while the engine is running), the canister vent solenoid may be de-energized and the CVV may be opened to allow a flow of fresh air to strip the stored vapors of the activated charcoal. Additionally, controller 12 may command CVV 132 to be intermittently closed, by adjusting operation of the canister vent solenoid, to diagnose reverse flow through the fuel vapor recovery system. In yet another example, during leak detection, the canister vent solenoid may be de-energized to close CVV 132, while CPV 134 and FTIV 124 are also closed, such that the canister side of fuel vapor recovery circuit is isolated. In this way, by commanding the CVV to be closed, the controller may seal the fuel vapor recovery system from the atmosphere.

Fuel vapors released from canister 130, for example during a purging operation, may be directed into intake manifold 60 via purge line 118. The flow of vapors along purge line 118 may be regulated by canister purge valve (CPV) 134, coupled between the fuel vapor canister and the engine intake. In one example, CPV 134 may be a ball check valve, although alternative check valves may also be used. The quantity and rate of vapors released by the CPV may be determined by the duty cycle of an associated solenoid (not shown). As such, the duty cycle of the canister purge valve solenoid may be determined by the vehicle's powertrain control module (PCM), such as controller 12, responsive to engine operating conditions, including, for example, an air-fuel ratio. By commanding the canister purge valve to be closed, the controller may seal the fuel vapor recovery system from the engine intake.

An optional canister check valve 136 may also be included in purge line 118 to prevent intake manifold pressure from flowing gases in the opposite direction of the purge flow. As such, the check valve may be necessary if the canister purge valve control is not accurately timed or the canister purge valve itself can be forced open by a high intake manifold pressure (such as, during boosted conditions). An estimate of the manifold absolute pressure (MAP) may be obtained from a MAP sensor (not shown) coupled to engine intake manifold 60, and communicated with controller 12. As such, check valve 136 may only permit the unidirectional flow of air from canister 130 to intake manifold 60. In the event of high pressure air entering the purge line from intake manifold 60, canister check valve 136 may close, thereby preventing the pressure in canister 130 from exceeding design limits. While the depicted example shows the canister check valve positioned between the canister purge valve and the intake manifold, in alternate embodiments, the check valve may be positioned before the purge valve. A second canister pressure sensor, such as canister pressure transducer (CPT) 138, may be included in purge line 118, coupled between canister 130 and CPV 134 to provide an estimate of a canister pressure. In alternate embodiments the CPT may be coupled to the vent between the canister and the CVV, or may be coupled to the vapor line between the canister and the fuel tank on the canister side of the fuel vapor circuit. Signals indicating canister pressure (Pc) are received by controller 12.

Fuel vapor recovery system 110 also includes vacuum accumulator 202 coupled to fuel vapor canister 130. In one example, vacuum accumulator 202 may be coupled through vacuum line 208 to purge line 118, between canister 130 and the CPV 134. In other example embodiments, the vacuum line may be coupled to the vapor line between the canister and the FTIV. Application of vacuum from the vacuum accumulator to the canister through vacuum line 208 is regulated by opening or closing vacuum accumulator valve (VAV) 204, as commanded by controller 12. VAV 204 may be selectively opened by controller 12 during emission leak detection operations, such as when insufficient engine-off natural vacuum is available, to provide additional vacuum for leak detection. For example, VAV 204 may be selectively opened during a secondary leak detection subroutine implemented under a condition wherein the absolute pressure of the fuel tank is less than a threshold, as further elaborated in FIG. 12.

In one embodiment, vacuum accumulator 202 may be coupled to intake manifold 60 through conduit 206, and may accumulate vacuum when the hybrid vehicle is operated in the engine-on mode. That is, the accumulator may store an amount of engine vacuum for later use. Additionally, or optionally, a venturi 258 may be coupled to vacuum accumulator 202 by venturi vacuum line 260. The venturi may be mounted at various locations on the body of the hybrid vehicle that receive air or exhaust flow during vehicle motion and operation. For example, the venturi may be mounted on the underside of the vehicle body. In another example, venturi 258 may be coupled to the exhaust manifold, for example along the tailpipe, such that vacuum may be generated due to the flow of exhaust through the venturi. In yet another example, as depicted, venturi 258 may be mounted in the exhaust pathway of a brake booster pump 32 coupled to a brake booster 34 of the vehicle brake system 30. Herein, during brake application, vacuum may be generated due to operation of the brake booster pump and flow of brake booster pump exhaust through the venturi. In one example, by coupling the venturi to the exhaust pathway of the brake booster pump, rather than directly coupling the vacuum accumulator to the brake booster pump, the brake booster pump may not be exposed to fuel vapors. In still other embodiments, vacuum accumulator 202 may be directly coupled to brake booster pump 32, wherein vacuum may be generated by operating the brake pump, and stored in the vacuum accumulator for use in leak detection routines.

Controller 12 may be configured to regulate various operations of the fuel vapor recovery system by receiving signals from sensors, such as pressure, temperature, and position sensors, and commanding on actuators, such as opening and closing of valves or the refueling door. For example, controller 12 may carry out various routines for leak detection, refueling, and fuel vapor purging. Specifically, the various routines for the fuel vapor recovery system may be better coordinated by controller 12, for example, by performing a higher-level vapor recovery system routine which may strategically implement each of the various routines depending on the operating conditions of the vehicle, such as engine-on or engine-off operations, and pressure and temperature inputs from sensors. For example, if a refueling routine is implemented, controller 12 may disable a purging routine.

An example higher-level vapor recovery system routine 3000 is depicted in FIG. 3. Herein, at 3002 it may be determined whether the vehicle is on or off, that is, whether or not the vehicle is operational. In one example, this may be detected by a key command sensor and/or motion sensor for the vehicle (not shown). If the vehicle is not being operated, the controller 12 may enable a leak detection routine at 3003. Leak detection may additionally be regulated by other factors recorded by the controller, such as time elapsed since a last leak detection routine occurred. In alternate embodiments, leak detection methods may be implemented while the vehicle is on, but in an engine-off mode of operation.

If the controller receives a signal that the vehicle is on, at 3004 it is determined if the vehicle is in an engine-on mode or an engine-off mode. If the vehicle is operating in an engine-off mode, the controller may implement the commands shown at 3008. Specifically, the controller may maintain a closed state for each of the FTIV and the CPV. That is, diurnal vapors may be stored in the fuel tank while refueling vapors may be stored in the canister. Additionally, purging routines may be limited for the duration of the engine-off mode of operation. Optionally at 3010, during the engine-off mode of operation, vacuum may be stored in the vacuum accumulator. Specifically, the controller may maintain the VAV closed while vacuum is generated at the venturi coupled to the vacuum accumulator. As previously elaborated, vacuum may be generated due to flow of air and/or exhaust through the venturi irrespective on engine operation mode, such as due to flow of ambient air during vehicle motion or exhaust flow from the brake booster pump.

If the vehicle is operating in an engine-on mode at 3004, then at 3006, the FTIV and CPV may be maintained in closed positions. At 3010, the controller may maintain the VAV closed while accumulating vacuum due to flow of air and/or exhaust through the coupled venturi. As such, in addition to the vacuum accumulation strategies described above, vacuum may also be generated by coupling the vacuum accumulator to the engine intake manifold.

Next, at 3014, purging conditions may be confirmed. Purging conditions may include detection of engine-on operations, a signal from the CPT that the canister pressure is above a predetermined threshold (such as, $threshold_2$ of FIG. 5), and/or a signal from the FTPT that the fuel tank pressure is above a threshold (such as, $threshold_3$ of FIG. 5). If purging conditions are confirmed, a purging routine (further depicted in FIG. 5) may be commanded at 3015. If purging conditions are not met, at 3018, the controller may maintain the closed positions of the FTIV and the CPV.

At 3016, independent of the vehicle operation mode, it may be determined if a fuel tank refueling is requested by the user. If no refueling request is received, the routine may end. In one example, a refueling request may be determined by the controller based on user input through a button, lever, and/or voice command. In response to a refueling request, a refueling routine (further depicted in FIG. 4) may be implemented at 3020. However, if the refueling request is received during a purging operation (such as, while purging operations of step 3015 are being performed), at 3020, the purging routine may be temporarily disabled for the duration of the refueling event, for example, by temporarily commanding the CPV closed. With this, the routine may end.

In this way, purging and refueling operations may be better coordinated so as to enable refueling only when fuel tank pressures are within a safe range, while staggering purging operations with refueling so as to reduce excess refueling fuel vapor flow into the engine intake.

Now turning to FIG. 4, a refueling routine 4000 is shown. At 4002, a user refueling request may be confirmed by the controller. In response to the refueling request, the controller may disable engine operations at 4006. At 4008, purging operations may be disabled, for example, by (temporarily) maintaining the CPV in a closed position. At 4010, the FTIV may be opened and the CVV may be maintained open. Herein, by opening the vapor line between the fuel tank side and the canister side of the fuel vapor circuit, pressure in the fuel tank may be relieved. For example, if a high pressure exists in the fuel tank, air and fuel vapors may flow from the fuel tank through the vapor line and into the canister. In another example, if a vacuum exists in the fuel tank, air may flow from the canister through the vapor line and into the fuel tank. In both examples, pressures of the fuel tank and the canister may go toward equilibrium, such that the fuel tank may be safely and easily opened.

At 4012, it may be determined whether the absolute value of the fuel tank pressure is below a predetermined threshold ($threshold_1$). If so, at 4016, refueling may be enabled. If the absolute value of the fuel tank pressure is greater than $threshold_1$, the controller may delay opening of the refueling door in command 4014, until the fuel tank pressure falls below $threshold_1$. The controller may enable refueling by commanding a refueling door to open, for example, by de-energizing a solenoid in the refueling door to enable door opening. The vehicle operator may then have access to the refueling line and fuel may be pumped from an external source into the fuel tank until refueling is determined to be complete at 4018.

Because the FTIV may remain open during the refueling operation, refueling vapors may flow through the vapor line and into the carbon canister for storage. Until refueling is complete, refueling operations may be maintained at 4020. If refueling is completed at 4018, for example based on input from the fuel level sensor, the refueling door may be closed at 4022, for example by energizing the refueling door solenoid. In response to refueling door closing, at 4024, the FTIV may be closed in thereby ensuring that refueling vapors are stored in the canister side of the fuel vapor circuit. Therein, the refueling routine may be concluded. In this way, refueling may be enabled only when fuel tank pressures are within a safe range, and improving coordination of refueling with purging.

Now turning to FIG. 5, a purging routine 5000 is depicted. Purging routine 5000 may be enabled in response to purging conditions being met (at 3014 of FIG. 3), such as when the vehicle is operated in an engine-on mode and a refueling event is not requested. At 5002, while the vehicle is operated in the engine-on mode, it may be determined if a canister pressure (Pc), for example as estimated by the CPT, is above a predetermined threshold for purging ($threshold_2$). If the canister pressure is above the threshold, and a refueling request is received at 5004, then at 5006, purging operations may be disabled at least for the duration of refueling, and refueling operations (FIG. 4) may be enabled at 5008. Specifically, CPV may be maintained closed for the duration of the refueling event.

If the canister pressure is above the threshold, and no refueling request is received at 5004, then at 5010, the controller may command the CPV to open while maintaining the FTIV closed and the CVV open. At 5012, air may flow from the atmosphere into the canister through the vent and a first amount of refueling vapors stored in the canister may be purged to the engine intake manifold. Thus, during the purging of the first amount of fuel vapors from the canister to the intake, no fuel vapors may be purged from the fuel tank to the canister. The first amount of purging may include an amount of fuel vapors (e.g., fuel mass), a duration of purging, and a rate of purging. As such, the CPV may be maintained open until the canister pressure, for example as estimated by the CPT, falls below a threshold ($threshold_2$), at 5014, at which time the CPV may be closed at 5016.

At 5018, purging conditions of the fuel tank may be determined, for example, based on a fuel tank pressure (such as estimated by the FTPT) being above a threshold for purging ($threshold_3$). If the fuel tank pressure is below $threshold_3$, the fuel tank may not require purging and therefore the FTIV may be maintained in a closed position at 5020 and the purging routine may end. If the fuel tank pressure is above $threshold_3$, the controller may command the FTIV to open at 5022, and at 5024 may bleed diurnal vapors, such as a second amount of fuel vapors, from the fuel tank through the vapor line into the canister. The second amount of purging may include an amount of fuel vapors (e.g., fuel mass), a duration of purging, and a rate of purging. The second amount may be based on the first amount purged from the canister. For example, as an amount and duration of purging of the first amount of fuel vapors from the canister increases, the second amount purged from the fuel tank may be increased. During the bleeding of diurnal vapors from the fuel tank, the canister pressure may be monitored and the FTIV may remain open (at 5028) at least until the canister pressure reaches a threshold. At 5026, it may be confirmed that the canister pressure is above a lower threshold but below an upper threshold ($threshold_4$). If the canister pressure is greater than or equal to $threshold_4$, the controller may command the FTIV to close at 5030 and the purging routine may be completed.

The above described methods, as shown in FIGS. 3-5 apply to basic functioning of a fuel vapor system as shown in FIG. 2. The remaining FIGS. describe variations to the basic system shown in FIG. 2 with variations to the methods of fuel vapor recovery or vapor pressure control noted. It should be appreciated, the concepts of the methods shown in FIGS. 3-5 apply to methods of operating the below described embodiments of a fuel tank pressure system.

Turning now to FIG. 6, a first embodiment of a fuel tank pressure system of the present disclosure is shown. The first embodiment 300 comprises the components of a general fuel system 100 as shown in FIG. 2. However, additional components are present stemming from the fuel tank 120 and vapor canister 130 to control the fuel tank pressure to minimize fuel oxidation.

As the canister 130 is loaded with refueling vapors and sits over time, a condition may occur in which a negative pressure is created internal to the fuel tank. The first embodiment of the present disclosure may comprise a pump 302. The vapors producing the negative pressure internal to the fuel tank may be pumped back into the fuel tank 120 to mitigate the creation of a negative vapor pressure within the fuel tank.

As plug-in electric vehicles need to have an external method of onboard (OBD) leak detection a pump that may operate as vapor pump 302 may be intrinsic to the vehicle and a controller 12 may comprise stored information to operate the pump to control for fuel tank pressure. For a pressurized leak detection system, running the pump would allow the HC vapors into the vapor dome of the tank.

In a variation of the first embodiment, a vacuum based system may be used in which vacuum pressure draws vapors back into the tank when a diverter valve opens. The diverter valve 306 (shown in dotted line) may actuate and pull air from the outside and through the normal evacuation port into the canister 130, pushing hydrocarbon vapors into the fuel tank to mitigate negative pressure and the introduction of air. The diverter valve may be arranged in a diverter line 305 stemming off the vapor canister. The diverter valve may also be located inline with vent 136. This system may comprise a hydrocarbon sensor 304 between the canister and the fuel tank to report the hydrocarbon concentration to the controller 12. The hydrocarbon sensor may sense hydrocarbon concentration in the vapor line and report the hydrocarbon concentration to an engine controller. In this way, controller 12 may control pump 302 to adjust the fuel tank pressure such that oxygen may not be introduced into the fuel tank.

Figure 7A:
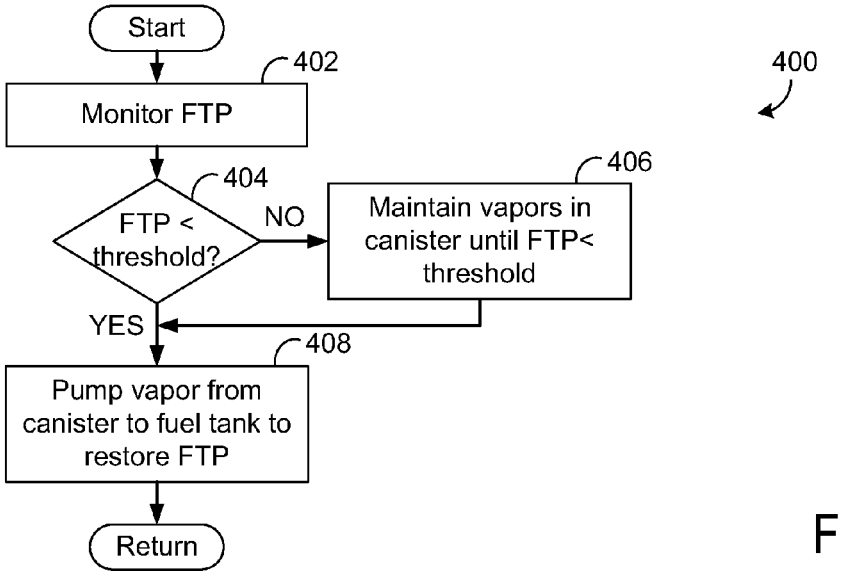
FIG. 7A shows a flowchart describing a method of the first embodiment of a fuel tank pressure system utilizing a vapor pump.

Turning now to FIG. 7A, a flowchart for a method of a first embodiment of a fuel tank pressure system is shown. The method 400 uses a vapor pump to maintain fuel tank pressure by pumping vapor from a vapor canister 130 to the fuel tank if pressure falls below a threshold. The method begins at 402 where fuel tank pressure (FTP) is monitored. FTP may be monitored by fuel tank pressure transducer (FTPT) 128. At 404, it is assessed if FTP is below a threshold. If FTP is not below threshold (NO) fuel vapor is maintain in the canister 130, separated by the fuel tank isolation valve 124 until FTP is below threshold (406). When FTP is below threshold (YES) the method proceeds to 408. At 408, vapor pump 302 is activated. The pump may comprise an existing pump within the fuel system, for example, a pump used for OBD leak diagnostics, so long as the pump is suitable to pump fuel vapor from canister 130 to tank 120. Pumping continues to restore fuel tank pressure. The method then returns. In this way vapors may be routed from the fuel system canister by activating a pump to evacuate the fuel system canister. The routing of vapors may occur without concurrently purging any fuel vapors to the engine.

Figure 7B:
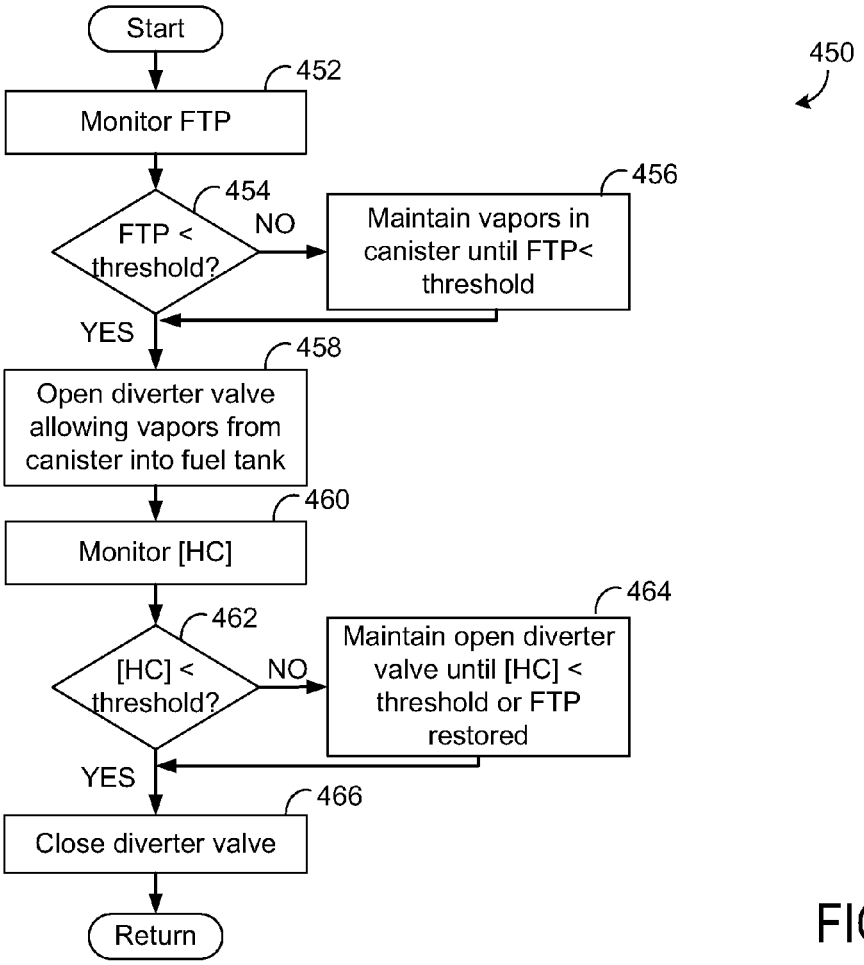
FIG. 7B shows a flowchart describing a method of the first embodiment of a fuel tank pressure system utilizing a diverter valve.

FIG. 7B shows an alternative method for a first embodiment of the fuel tank pressure system of the present disclosure. The method variant shown in FIG. 7B refers to a case in which a vacuum pressure is used to return fuel vapor from canister 130 to a fuel tank 120. A diverter valve 306 is opened to allow air into the vapor canister to push vapors into fuel tank 120. A hydrocarbon sensor 304 may monitor the hydrocarbon concentration ([HC]) of vapors such that a diverter valve may be closed if the [HC] is below a threshold to prevent atmospheric air comprising oxygen into the fuel tank that may contribute to fuel oxidation.

The method 450 begins at 452 where FTP is monitored as at 402. At 454 it is assessed if FTP is below a threshold. The threshold may be a pressure below which a vacuum may be created in the fuel tank relative to external parts of fuel system 100. The presence of a vacuum may allow atmospheric air comprising oxygen into the fuel tank. If FTP is not below a threshold (NO) fuel vapors are maintained in the canister, at 456, by the continued closure of the diverter valve 306 and the fuel tank isolation valve 124. If FTP is below a threshold (YES) the method proceeds to 458 where the diverter valve 306 is providing a force for vapors to exit the canister 130 to enter the fuel tank 120.

At 460, HC sensor 304 monitors hydrocarbon concentration. At 462 it is determined if the concentration of hydrocarbons is below a threshold. If the concentration of hydrocarbons is not below the threshold (NO), the method proceeds to 464 where the diverter valve is maintained in the open position until the concentration of hydrocarbons is below a threshold or FTP is increased above the threshold. If the concentration of hydrocarbons is below the threshold (YES), the method proceeds to 466 where the diverter valve is closed. The threshold level of hydrocarbon concentration may be indicative of atmospheric air mixing with the vapors in the canister. Admission of oxygen containing atmospheric air into the fuel tank may contribute to fuel oxidation. In this way, the method 450 may comprise sensing hydrocarbon concentration of the fuel vapors exiting the canister and entering the fuel tank, and closing the diverter valve when the hydrocarbon concentration is below a threshold concentration, but maintaining the valve open when the hydrocarbon concentration is above the threshold concentration, the engine maintained at rest and non-combusting during both the open and closed diverter valve operation.

Turning now to FIG. 8, variations of a second embodiment of the fuel tank pressure system are shown. In the second embodiment, the fuel tank 502, or a portion of the fuel tank may comprise a contractable material. Such a material may form a wall, or portion of a wall, of the fuel tank, or may be formed as an inner skin that may contract under vacuum within a rigid outer tank. This inner skin may line the fuel tank or form a flexible tank within the rigid body outer fuel tank. For example, in FIG. 8A, the fuel tank may comprise an outer vessel 502 with an inner skin 504 that may contract in the presence of a vacuum to minimize draw of atmospheric air into the fuel tank. As another example, shown in FIG. 8B, a portion of the fuel tank 502 wall may comprise a contractable material 506. The contractable material portion 506 may comprise a flexible membrane or other material and may be malleable enough to contract inward within the tank in the event of vacuum pressure. The contractable material may be welded, glued or otherwise attached to the rigid material comprising the greater fuel tank wall. In another example shown in FIG. 8C, a contractable bladder 510 may be attached within a wall of the fuel tank. The attachment may be by gluing, welding, or other method. Under conditions of vacuum pressure, air or an inert gas contained within the bladder may expand to fill negative space within the fuel tank (indicated at 508). Gas sealed within the bladder may exhibit properties different from fuel vapor such that it may expand in cooling conditions and contract upon heating. The contractable bladder contains an inert gas.

Turning now to FIG. 9, a third embodiment of the present disclosure is shown. In the third embodiment of the fuel tank pressure system of the present disclosure an expandable foam or other media may be present within the fuel tank 602. The foam or media may expand when exposed to fuel vapor and be inert in air. As pressure differences were encountered internal to the vapor dome in the fuel tank the foam may be able to expand and negate the progression of negative pressure keeping the pressure in the fuel tank within predetermined thresholds. In the first variation shown in FIG. 9A foam 604 may be a closed cell foam with pockets filled with a gas or mixture of gases having desired expansion qualities. The shape of a foam insert in a fuel tank may vary with the dimensions of a stock fuel tank. A foam insert may be created to fit an existing fuel tank which may reduce production and design costs. Furthermore, a shape or size of a foam insert may vary with a material used and by the type or content of entrapped gas. Another example variation to the shape of a foam insert is shown in FIG. 9B. The foam may appear in a serpentine fashion along a wall of the fuel tank 604. Upon vacuum conditions, the foam may expand (indicated in dashed line at 606) to fill negative space within the fuel tank and mitigate vacuum pressure which may draw oxygen containing atmospheric air into the fuel tank.

Turning now to FIG. 10, a fourth embodiment of the fuel tank pressure system is shown. To mitigate oxygen ingestion internal to the fuel tank on NIRCOS or sealed evap systems, using an active pressure control device 700 may have several benefits. The active control device may comprise an expandable diaphragm 708 internal to the fuel tank 702. This diaphragm 708 may be controlled actively by a low flow pump 714, as pressure changes may not occur rapidly. The diaphragm internal to the fuel tank may be a balloon or other material that may contain fresh air or other media, allowing pressure to build within the diaphragm, displacing a vacuum in the fuel vapors. In the fourth embodiment a fuel tank pressure system may comprise a contractable diaphragm within the fuel tank and a pump suitable to fill the contractable diaphragm under a negative pressure condition of the fuel tank.

Adding volume to the diaphragm may offset negative pressure, allowing pressure within the fuel tank to be maintained between predetermined thresholds to prevent air ingestion into the fuel tank. In line with the low flow pump 714 may be a pressure transducer 710 that is active during the vehicle operation. The DCM 704 may monitor the fuel tank pressure and provide feedback to engine controller 12 (shown in FIG. 2) to control expansion of the diaphragm 708 as required to offset negative pressure. The active pressure control device of the present system may also comprise a valve 712. The valve may be closed to maintain pressure within the diaphragm once the pressure transducer 710 reads a pressure within thresholds. Furthermore, a pressure switch (DCM) 704 may sense pressure within the fuel tank 702. The fuel tank pressure may be used by the engine controller to control low flow pump 714.

Furthermore, the system may operate approximately 1 hour after key off to re-evaluate the pressure state in the fuel tank and adjust the diaphragm volume as required to maintain the tank pressure between the predetermined thresholds. The diaphragm 708 may contract through a venting mechanism when a refueling request occurs to prepare the fuel system for refueling. The venting system may be external to the vapor dome of the fuel tank 702. The venting system may utilize valve 712.

NIRCOS fuel tanks may be designed to withstand a 45 kpa positive pressure and a 21 kpa negative pressure. The fourth embodiment of the present disclosure may allow a NIRCOS system to use a current production fuel tank (designed to 3 kpa negative pressure and 14 kpa positive pressure) with modifications to meet the more stringent NIRCOS requirements.

A method for operating the active pressure control device 700 of FIG. 10 is shown in FIGS. 11 and 12. Turning to FIG. 11, the method 800 starts at 802 when the DCM 704 reads the vapor pressure in the tank. The method proceeds to 804 where it is determined if pressure within the tank is within a predetermined range. The predetermined range may vary with the type or size of the fuel tank, or additional components within the fuel system. If at 804, if the pressure is within the predetermined range (YES) the method returns.

If the pressure is outside of the predetermined range (NO) the method proceeds to 806 where it is determined if the vehicle is operating with the engine on. If the vehicle is not operating with the engine on (NO) the method proceeds to FIG. 12 at 808. If the vehicle is operating with the engine on (YES) the method proceeds to 810.

At 810, it is determined if the inferred ambient temperature is rising. The inferred ambient temperature may be inferred based on pressure and temperature readings within the engine or by an ambient temperature sensor. If the inferred temperature is not rising (NO) the diaphragm 708 is inflated to within the predetermined range at 812. If the inferred temperature is rising (YES) the method proceeds to 814. At 814, the diaphragm is over deflated to overcome additional heat input and rise in vapor pressure. The extent of deflation may be based on the temperature, pressure, speed of temperature rise, etc. Furthermore, the extent of deflation may be determined by a look up table referencing the above mentioned factors. The look up table may be stored in engine controller 12.

Turning now to FIG. 12, the method continues from 808 in FIG. 11 after it determined the vehicle is not operating with the engine on. The method continues to step 902 where it is determined if the vehicle is operating with electric power only. If at 902, the vehicle is not operating with electric power only the method proceeds to step 904. At 904, it is determined if the vehicle is keyed on? If yes, the method returns to 802 in FIG. 11. If the vehicle is not keyed on (NO), the method proceeds to 912.

At 912, it is determined if the ambient temperature is predicted to rise. If the ambient temperature is predicted to rise (YES) the method proceeds to 914. At 914, the diaphragm is over-deflated to preclude vapor pressure outside the predetermined range. If the ambient temperature is not predicted to rise (NO), the method proceeds to 916.

At 916, it is determined if the ambient temperature is predicted to fall. If the ambient temp is predicted to fall (YES), the method proceeds to 918, where the diaphragm is overinflated to compensate for cooling of fuel and increased negative pressure. The degree of over inflation may be based on temperature and pressure and may be stored in a look up table. If the ambient temperature is not predicted to fall (NO)

the method proceeds to 920 where the current pressure in the diaphragm is maintained. The method then returns to 802 in FIG. 11.

Returning to 902, if the vehicle is operating under electric power only (YES), the method proceeds to 906 where it is determined if the ambient temperature is rising. If the ambient temperature is not rising (NO) the method proceeds to 908. At 908, the diaphragm is overinflated to the predetermined pressure range. If the ambient temperature is rising (YES) the method proceeds to 910. At 910, the diaphragm is deflated to return to the predetermined pressure range. The method returns to 802 in FIG. 11.

Turning now to FIG. 13, a fifth embodiment of the fuel tank pressure system of the present disclosure is shown. An active pressure control device similar to that described in the fourth embodiment is depicted. The active pressure control device 1000 of the present embodiment features a contractable diaphragm 1004 that is external to the fuel tank 1002. The diaphragm may be located within an expansion chamber 1006. The expansion chamber may be a pass-through for fuel vapor during refueling or may an additional branch off the vapor management system comprising vapor line 112 and FTIV 124. An additional shut off valve 1008 may be contained in line with the pump 1010. The pump may vent into the air or the canister. The method of operating the active pressure control device 1000 will be analogous to that for active pressure device 700 as described in reference to FIGS. 11 and 12. In the fifth embodiment a fuel tank pressure system may comprise a contractable diaphragm within the expansion chamber external to the fuel tank and a pump suitable to fill the contractable diaphragm under a negative pressure condition of the fuel tank.

Turning now to FIG. 14, a sixth embodiment of the present disclosure is depicted. To mitigate against a vacuum draw in the fuel tank, caused by either a significant temperature variation or barometric pressure change, a variable volume material 1104 would be used internal to the fuel tank 1102. At atmospheric pressure the material would maintain a defined volume. As vacuum pressure is asserted on the fuel tank, the variable volume material 1104 may expand and thereby maintain the fuel tank vapor pressure within a predetermined threshold. The expandable material may be passive and react to a pressure differential.

Variations or combinations of the above described embodiments are possible without straying from the present disclosure, including variations of the materials, shapes, alignment, or construction of the above described components. A method is disclosed comprising, when fuel tank pressure is below a threshold, routing vapors from a fuel system canister to the fuel tank to maintain the fuel tank pressure at a desired pressure. The method may utilize a system comprising: a fuel tank; a pressure sensor to sense vapor pressure within the fuel tank; a vapor canister; a vapor line between the fuel tank and the vapor canister; and a pump located in the vapor line. In another embodiment the system may comprise a fuel tank; a pressure sensor to sense vapor pressure within the fuel tank; a vapor canister; a vapor line between the fuel tank and the vapor canister; and a diverter valve. The diverter valve may allow air into the vapor canister pushing vapors from the canister into the fuel tank under conditions of negative pressure.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code, executable by a processor, to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

responsive to fuel tank pressure below a threshold, routing fuel vapors from a fuel system canister to the fuel tank to maintain the fuel tank pressure at a desired pressure;

sensing hydrocarbon concentration of the fuel vapors exiting the canister and entering the fuel tank; and stopping the routing responsive to an indication that atmospheric air comprising oxygen is being introduced into the fuel tank.

2. The method of claim 1, wherein routing fuel vapors from the fuel system canister comprises activating a vapor pump to evacuate the fuel system canister; and wherein stopping the routing comprises controlling the vapor pump such that oxygen is not introduced into the fuel tank.

3. The method of claim 1, wherein routing fuel vapors from the fuel system canister to the fuel tank comprises actuating open a diverter valve between the canister and atmosphere in a diverter line stemming off the canister to draw air into the fuel system canister pushing fuel vapors into the fuel tank; and wherein stopping the routing comprises actuating closed the diverter valve.

4. The method of claim 1, wherein the desired pressure includes fuel tank pressure above the threshold, and wherein the routing is stopped responsive to fuel tank pressure above the threshold.

5. The method of claim 1, wherein the routing reduces fuel oxidation and chemical degradation of fuel system components.

6. A system for reducing fuel oxidation, comprising:

a fuel tank;

a pressure sensor to sense vapor pressure within the fuel tank;

a vapor canister coupled to atmosphere via a diverter line and coupled to the fuel tank via a vapor line;

a fuel tank isolation valve positioned in the vapor line;

a diverter valve positioned in the diverter line;

a hydrocarbon sensor positioned between the fuel tank and the fuel vapor canister; and a controller storing instructions in non-transitory memory, that when executed, cause the controller to:

responsive to an indication that fuel tank pressure is below a threshold, actuating open the diverter valve to pull air into the canister, pushing hydrocarbon vapors into the fuel tank to mitigate negative fuel tank pressure;

monitor a hydrocarbon concentration in the vapor line via the hydrocarbon sensor; and in a first condition, close the diverter valve responsive to fuel tank pressure above the threshold; and in a second condition, close the diverter valve responsive to hydrocarbon concentration below a threshold;

wherein closing the diverter valve responsive to hydrocarbon concentration below the threshold prevents atmospheric air comprising oxygen into the fuel tank.

7. The system of claim 6, further comprising an expandable foam within the fuel tank; and wherein the foam expands responsive to negative fuel tank pressure to keep the fuel tank pressure within predetermined thresholds.

8. The system of claim 6, further comprising a contractible inner skin within the fuel tank, the inner skin lining the fuel tank within a rigid body outer fuel tank; and wherein the inner skin contracts in the presence of vacuum to keep the fuel tank pressure within predetermined thresholds.

9. The system of claim 6, further comprising a portion of a fuel tank wall comprised of a contractible material, the contractible material attached to rigid material comprising the fuel tank wall; and wherein the contractible material contracts inward in the event of negative pressure in the fuel tank.

10. The system of claim 6, further comprising a contractible bladder within the fuel tank that expands responsive to negative fuel tank pressure to keep the fuel tank pressure within predetermined thresholds; and wherein the contractible bladder contains an inert gas.

11. The system of claim 6, wherein the vapor canister is part of a non-integrated refueling canister only system.

* * * * *